250-506.1

OR 4,277,688

T 250/506.1

United Stat

Yamamoto et al.

[1] 4,277,688

[45] Jul. 7, 1981

[54] CASK BAGGING DEVICE

[75] Inventors: Masahiko Yamamoto; Yoshinori Nishino, both of Osaka, Japan

[73] Assignee: Hitachi Shipbuilding & Engineering Company Limited, Osaka, Japan

[21] Appl. No.: 39,152

[22] Filed: May 15, 1979

[30] Foreign Application Priority Data

May 15, 1978 [JP] Japan ..... 53-65341[U]
Jan. 23, 1979 [JP] Japan ..... 54-06732
Jan. 29, 1979 [JP] Japan ..... 54-09331

[51] Int. Cl.[3] ..... G21F 5/00
[52] U.S. Cl. ..... 250/506; 250/515
[58] Field of Search ..... 250/506, 507, 515, 519; 176/87, DIG. 2

[56] References Cited

U.S. PATENT DOCUMENTS 3,152,033 10/1964 Black et al. ..... 250/515
3,659,108 4/1972 Quase ..... 250/519
4,090,087 5/1978 Weissenfluh ..... 250/519

FOREIGN PATENT DOCUMENTS 52-106800 12/1975 Japan .
52-135998 11/1977 Japan .

*Primary Examiner*—Bruce C. Anderson
*Attorney, Agent, or Firm*—Whittemore, Hulbert & Belknap

[57] ABSTRACT

A device comprises a bag for covering a cask for transporting a used nuclear fuel to prevent the outer surface of the cask from contamination with the contaminated water of a fuel storage pool when the cask is immersed in the pool. An annular tube inflatable with a pressure gas injected thereinto is provided along the open end of the bag to hold the opening edge in pressing contact with the outer surface of the cask and thereby seal off the interior of the bag. Preferably the bag is provided with means for adjusting the pressure of the gas in accordance with the pressure of water at the depth at which the cask is positioned. The device is also useful for casks for transporting other radioactive fissionable materials.

14 Claims, 14 Drawing Figures

CASK BAGGING DEVICE

The present invention relates to a device comprising a bag for covering a cask for transporting radioactive fissionable materials such as a used nuclear fuel to prevent the outer surface of the cask from contamination with the contaminated water of a fuel storage pool.

The nuclear fuel used in a nuclear reactor (hereinafter referred to simply as "fuel"), for example, is transported to a fuel reprocessing plant as accommodated in a special container to prevent the radioactive contamination of the environment during the transport. The fuel transport container is usually called a "cask." To assure safety against the radioactivity, the fuel is placed into the cask as submerged in the pool in which the fuel is stored. The water of the fuel pool, which is in direct contact with the fuel, usually has a considerably high level of radioactivity, which invariably contaminates the outer surface of the cask. Consequently there arises the necessity of removing the contaminant from the cask outer surface after the cask has been withdrawn from the pool with the fuel contained therein. This procedure, however, is difficult and requires much labor and time since the cask has a large number of cooling fins on its outer surface as is well known. To simplify the removal of the contaminant to the greatest possible extent, it is known to render the cask free from contaminant before immersion into the fuel pool, for example, by covering the cask with a bag of impermeable flexible sheet. As such a bagging method, it has heretofore been proposed to bag a cask and fasten the edge of the bag opening with a stainless steel band into pressing contact with the outer surface of the cask to seal off the interior of the bag. The proposed method nevertheless involves the problem of failing to provide perfect liquid tightness and being inefficient to practice. It has also been proposed to inject clean water into the bag under pressure to prevent the contaminated water from penetrating into the bag, but this method still has the drawback that after the cask has been withdrawn from the pool, the water within the bag must be disposed of by a cumbersome procedure which leads to a reduced efficiency.

The main object of this invention is to provide a cask bagging device which affords a reliable seal between the opening edge of the bag and the outer surface of a cask and which ensures an efficient operation.

To fulfil this object, the present invention provides a cask bagging device comprising a bag and a flexible annular tube disposed at the opening end of the bag. A pressure gas is fed to the annular tube to cause the pressure to hold the opening end in pressing contact with the outer periphery of the cask to seal off the bag.

According to a preferred embodiment of the invention, the annular tube is adapted to fit into the space between a pair of adjacent fins among a large number of annular fins on the outer surface of the cask, and/or a member of high rigidity is held in contact with at least part of the outer surface of the annular tube except where the tube is in contact with the cask outer surface, the annular tube thus providing a reliable seal.

When the cask bagged in the device is immersed into the fuel pool with the pressure gas fed to the annular tube to seal off the bag, the pressure of the water will act on the tube in accordance with the submerged position of the cask, thus reducing the sealing function of the tube. While it appears useful to give the tube such initial pressure that the liquid tightness will not be impaired when subjected to the water pressure, a problem will then arise in respect of the strength of the fins because the thinner the fins, the higher are the characteristics thereof so that it is not desirable to increase the thickness of the fins for reinforcement. Furthermore the bag will be subjected to the external water pressure in corresponding relation to the submerged position. The bag will not be liable to damage despite the water pressure if made from a material of high strength, but this is in conflict with the requirement that the bag be made of thin combustible material so as to be disposable with ease after use.

According to another preferred embodiment of the present invention, the device is provided with means disposed close to the annular tube for detecting the external water pressure and a system for controlling the pressure of gas to be supplied to the tube in accordance with the external water pressure detected, whereby a constant pressure difference is maintained at all times between the inside and outside of the annular tube to assure liquid tightness with stability without any adverse effect on the strength of the fins. Additionally the pressure gas is also fed to the interior of the bag under similar control so that the external pressure on the bag is limited to a specified range, rendering the bag serviceable free of any damage notwithstanding that it is made of combustible lightweight material.

Preferably the interior of the bag is maintained at a specified negative pressure to keep the bag in intimate contact with the cask before the cask is immersed into the pool so that the bag will not be damaged by engagement with part of some other article or apparatus during handling. When the cask has been placed into the body of water, the interior of the bag is usually adjusted by the control system to a predetermined negative pressure relative to the external pressure of water, whereby the bag can be held in its initial state as fitted to the cask throughout the whole process of immersion into the fuel pool and withdrawal therefrom. On the other hand, the interior of the bag, which is at the specified negative pressure before immersion into the pool, may be controlled to a slightly positive pressure relative to the external water pressure on immersion into the pool to preclude the penetration of contaminated water into the bag more effectively. In this case, however, the positive pressure in the bag will inflate the bag when the cask is withdrawn from the pool. Further in this case, the pressure line for feeding the pressure gas to the bag must be provided with an intermediate start valve which opens the line on detecting the immersion of the cask into the water.

Various other features of the present invention will become more apparent from the following description of the preferred embodiments with reference to the accompanying drawings, in which.

Figure 1:
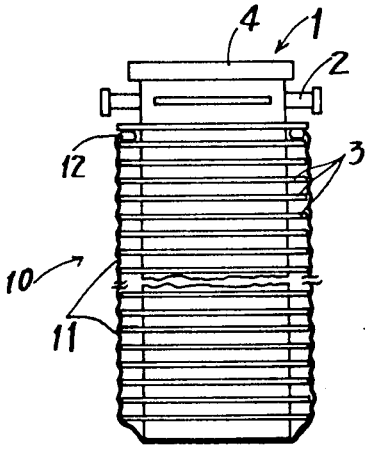
FIG. 1 is a view in vertical section schematically showing a first embodiment of the cask bagging device according to the invention.
Figure 2:
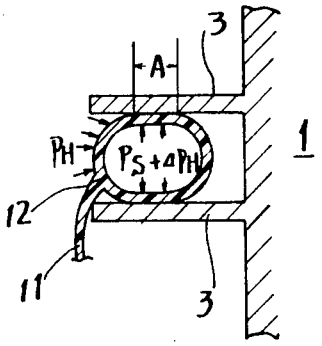
FIG. 2 is a view in section showing an annular tube as fitted in the space between fins.

With reference to FIG. 1, a cask 1 has a pair of trunnions 2 for suspending the cask 1 and a large number of annular cooling fins 3. With this cask 1, the trunnions 2 are disposed near the open upper end thereof, with almost all the annular fins 3 positioned below the trunnions 2. A bagging device 10 covering the outer surface of the cask 1, especially the finned portion thereof, comprises a bag 11 in the form of a tubular sheet closed at one end and an annular tube 12 attached to the open end of the bag 11. To facilitate the disposal of the device after use, the bag 11 and the annular tube 12 are preferably made from a combustible material such as rubber, synthetic resin or composite material made of rubber and resin. The annular tube 12, which has relatively high flexibility so as to be deformable in section, is fitted in the space between a pair of adjacent upper fins among the multiplicity of fins 3, as somewhat flattened in section as seen in FIG. 2. A pressure gas, when fed to the annular tube 12, holds the tube 12 in pressing contact with the pair of fins 3 to seal off the opening of the bag 11. In order to assure proper liquid tightness with the strength of fins 3 considered, it is desired that the width of contact, A, between the tube 12 and the fins 3 radially of the cask 1 be at least 30 mm and that the internal pressure of the tube 12 be set at a value $P_S$ which is 1.2 to 1.5 kg/cm$^2$.

When a fuel is to be accommodated in the cask 1, the bagging device 10, namely the bag 11 with the annular tube 12 attached to its open end, is fitted over the cask 1, and the annular tube 12 is fitted into the space between the uppermost pair of annular fins 3 as seen in FIG. 1. Subsequently a pressure gas is fed to the annular tube 12 to seal off the opening of the bag 11, while a specified negative pressure is applied to the interior of the bag 11 to hold the bag 11 in intimate contact with the outer surface of the cask 1. The cask 1 thus made ready for use is immersed into the fuel pool, the fuel is placed into the cask 1 as immersed in the water, the lid (not shown) of the cask 1 is closed for sealing, and the cask is withdrawn from the fuel pool. With the pressure gas thereafter released and the bag 11 opened to the atmosphere, the bagging device 10 is removed from the cask 1. The above operation is carried out while the cask 1 is held suspended from a crane. The bagging device 10 removed from the cask 1 may be used again but is usually burned immediately for disposal. On the other hand, the cask 1 is decontaminated over the portion left uncovered with the bag and other desired portion and then transported to the destination contemplated. The fuel is withdrawn from the cask 1 substantially in the same manner as above. For the transport of other radioactive fissionable materials, the cask 1 and the present device 10 are used similarly when accommodating the material in the cask and withdrawing the same therefrom.

Figure 5:
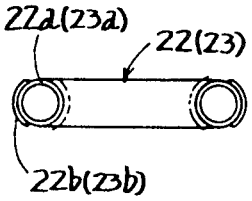
FIG. 5 is a side elevation in vertical section showing the annular tube of the embodiment shown in FIG. 3.
Figure 6:
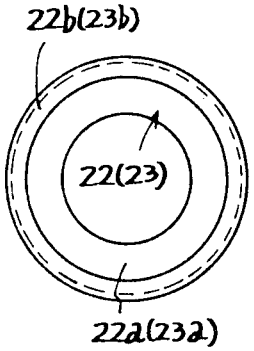
FIG. 6 is a plan view of FIG. 5.
Figure 7:
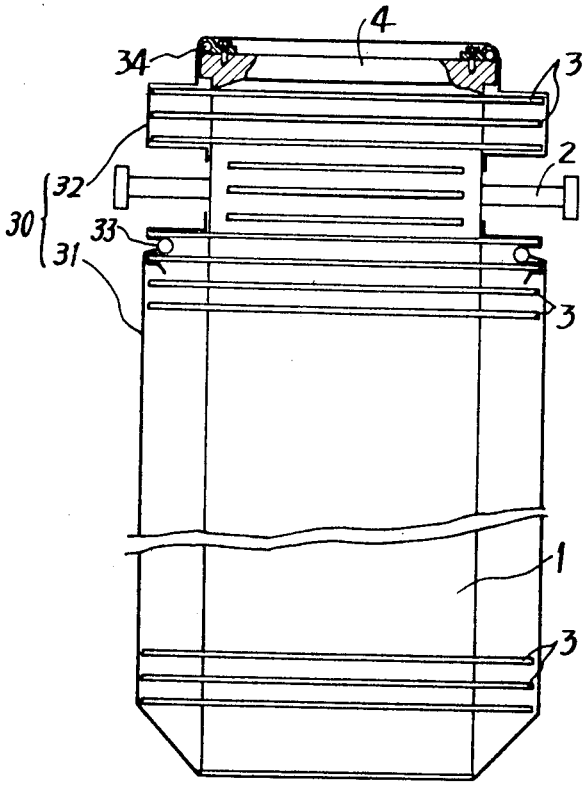
FIG. 7 is a view in vertical section schematically showing a third embodiment.
Figure 8:
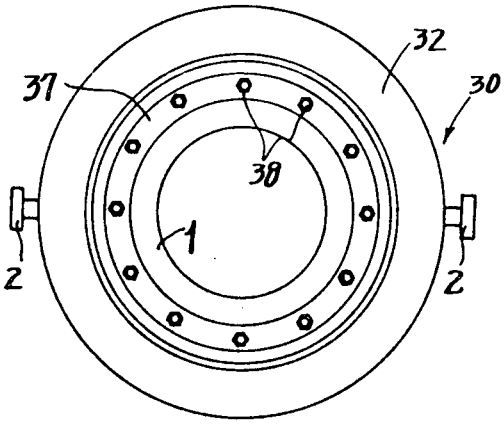
FIG. 8 is a plan view of FIG. 6.

FIGS. 3 to 6 show another embodiment for use with a cask 1 having trunnions 2 at an axially intermediate portion thereof and a number of fins 3 positioned above and below the trunnions 2. Indicated at 4 is a flange for attaching a lid to the cask 1. A bagging device 20 useful for this embodiment comprises a bag 21, a first annular tube 22 fittable to the outer periphery of the flange 4, and a pair of second annular tubes 23 fittable around the trunnions 2. The bag 21 has a rubber bottom plate 24, a tubular sheet 25 extending upward from the bottom plate 24 and surrounding the body of the cask 1, and a pair of auxiliary tubular sheets 27 each having one end integral with the tubular sheet 25 and the other end apertured as at 26 to fit around the trunnion 2. The tubular sheet 25 and auxiliary tubular sheets 27 are both bellows-shaped. Of the folds of major and minor diameters of the tubular sheet 25, the annular folds 25*a* of major diameter are each internally provided with a synthetic resin annular rib 28. Similarly the annular folds 27*a* of minor diameter of each auxiliary tubular sheet 27 is internally provided with an annular rib 29. The peripheral edge portion 25*b* of the tubular sheet 25 defining its opening is fitted around the flange 4, with the first annular tube 22 fitting around the edge portion 25*b*. The apertured portion 27*b* of each auxiliary tubular sheet 27 is fitted around the base portion of each trunnion 2, with the second annular tube 23 fitting to the apertured portion 27*b* from outside. As shown in FIGS. 5 and 6, the annular tubes 22, 23 comprise deformable and inflatable annular tubular members 22*a*, 23*a* provided with plate coatings 22*b*, 23*b* of high rigidity respectively over the radially outer surface of the outer periphery of the member except where the tube is pressed against the cask, i.e. against the flange 4 or trunnion 2. Accordingly the annular tubes 22, 23, when subjected to the internal pressure of the gas supplied thereto, will inflate radially inwardly thereof as indicated in phantom lines in FIG. 5.

Figure 3:
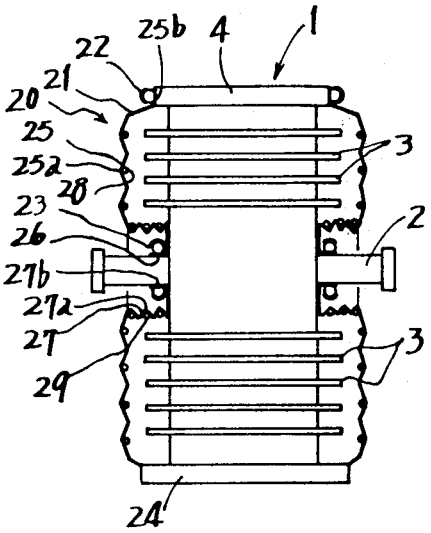
FIG. 3 is a view in vertical section schematically showing a second embodiment.
Figure 4:
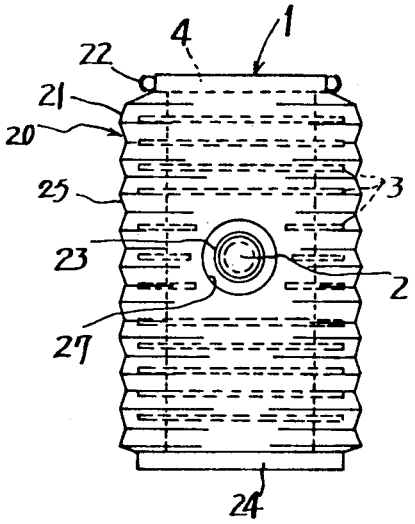
FIG. 4 is a front view of FIG. 3.

When a fuel is to be placed into the cask, the bag 21 and the first and second annular tubes 22, 23 are fitted to the cask 1 as shown in FIG. 3, and pressure gas is fed to the annular tubes 22, 23 to seal off the openings of the bag 21. When the cask 1 is immersed into the fuel pool, the interior of the bag 21 is pressurized. The fuel is placed into the cask 1 in the same manner as in the first embodiment, the cask 1 is then withdrawn from the pool, the annular tubes 22 and 23 are thereafter allowed to contract, and the annular tubes 22, 23 and bag 21 are removed from the cask 1. The same procedure as in the first embodiment subsequently follows. The pressure thus applied to the space between the bag 21 and the cask 1 eliminates any likelihood of the contaminated water penetrating into the bag 21, rendering the cask free from contamination with improved effectiveness. The tubular sheet 25 of the bag 21, when held away from the outer peripheries of the fins 3 on the cask 1 in this way, is unlikely to be damaged by contact with the fins 3. The bellows-shaped construction further makes the bag 21 fittable to and removable from the cask with greater ease.

Figure 9:
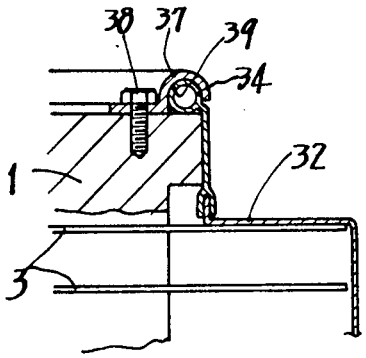
FIG. 9 is an enlarged view in section showing the bag of the third embodiment as sealed at the opening end of a cask.
Figure 11:
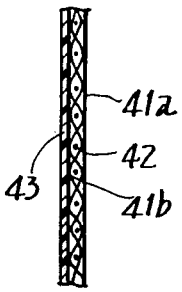
FIG. 11 is a diagram in section showing the sheet forming the bag.
Figure 10:
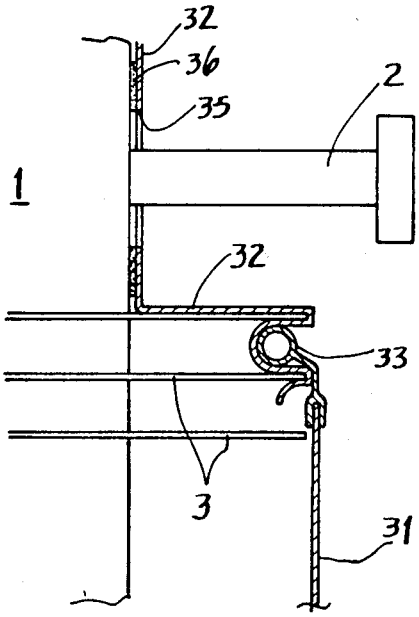
FIG. 10 is an enlarged view in section showing the bag as sealed below a trunnion on the cask.

FIGS. 7 to 10 show a third embodiment for use with a cask 1 which is similar in concept to the one used in combination with the second embodiment. Trunnions 2 are positioned slightly higher with some annular fins 3 also disposed above the trunnions 2. A bagging device 30 comprises a lower bag segment 31 in the form of a bottomed tubular sheet for covering the portion of the cask 1 below the trunnions 2 and an upper bag segment 32 in the form of a tubular sheet extending from the upper end of the cask 1 to the upper end of the lower bag segment 31 for covering the upper portion of the cask 1. The lower bag segment 31 is integral with a first annular tube 33 at the open end thereof, while the upper bag segment 32 is integral with a second annular tube 34 at its open end corresponding to the open upper end of the cask 1. As seen in FIG. 10, the upper bag segment 32 has apertures 35 for passing the trunnions 2 therethrough, and a tacky or adhesive coating 36 is formed on the rear surface of the peripheral portion defining each of the apertures 35. FIG. 9 shows an annular fastening member 37 attached to the upper end of the cask 1 by screws 38 and formed on the under side of its outer periphery with an annular recess 39 semicircular in cross section for the second annular tube 34 to fit in.

When the cask 1 is to be covered with the bag, the cask 1 is placed on the bottom of the lower bag segment 31 spread over the floor, and the upper bag segment 32 is fitted over the upper portion of the cask 1 with the trunnions 2 passed through the apertures 35. The release paper affixed to the adhesive coatings 36 is removed therefrom, and the inner peripheral portions of the segment 32 defining the apertures 35 are attached to the outer surface of the cask 1 with the adhesive coatings 36. The lower end of the upper bag segment 32 is made to extend over the two fins 3 immediately below the trunnions 2. The second annular tube 34 at the upper end of the segment 32 is placed on the top of the cask 1 along its outer periphery. Subsequently the fastening member 37 is placed on the top of the cask 1 with the second annular tube 34 fitted in the annular recess 39, and fastened to the top of the cask 1 with the screws 38. A pressure gas is thereafter forced into the second annular tube 34 to inflate the tube 34 into pressing contact with the top of the cask 1 and with the fastening member 37, causing the tube 34 to seal off the bag opening. The first annular tube 33 at the upper end of the lower bag segment 31 is then lifted with a jig and inserted into the space between the two fins 3 immediately below the trunnions 2. With the lower end of the upper bag segment 32 positioned inside the lower bag segment 31, the first annular tube 33 opposes the two fins 3 with the lower end held therebetween. The first annular tube 33 is then inflated with the pressure gas forced thereinto and thereby pressed against the fins 3 with the lower end of the segment 32 interposed therebetween, thus sealing the joint between the upper and lower bag segments 32 and 31.

A fuel is placed into or out of the cask 1 in the same manner as is the case with the first embodiment. The bag of the third embodiment which comprises the divided upper and lower segments 32 and 31 is fittable over the cask 1 with greater ease than a single elongated bag and will not be broken by engagement of the bag with the fin. Even if one of the bag segments should be broken, the contaminated water will not ingress into the other bag segment. The lower bag segment 31, which need not be passed over the trunnions 2, has only to be made diametrically slightly larger than the outside diameter of the fins 3.

Preferably the bags 11, 12 and bag segments 31, 32 may be made from a composite material comprising two synthetic resin films 41*a* and 41*b*, a synthetic resin fiber fabric 42 sandwiched between the films, and a lining 43 of natural rubber or like soft rubber formed over the film 41*b* to be positioned closer to the cask 1. Needless to say, also useful are other highly flexible sheets of rubber or synthetic resin which are impermeable and combustible.

Figure 12:
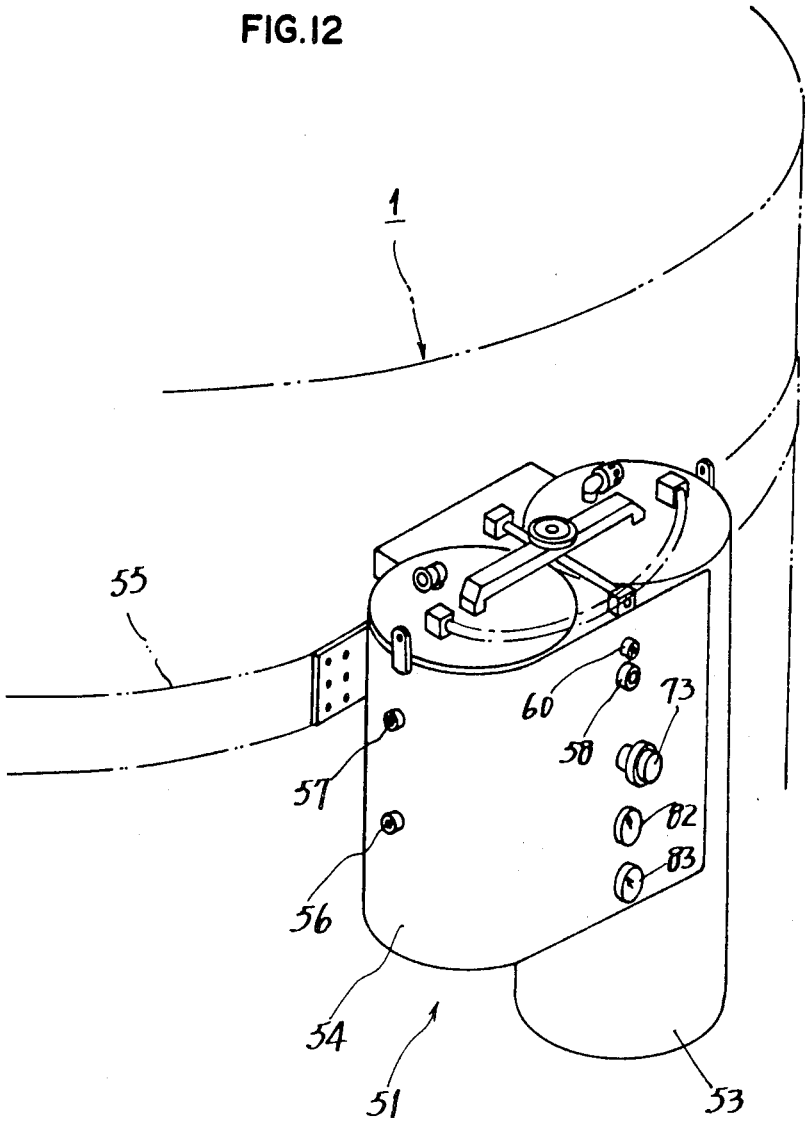
FIG. 12 is a perspective view showing a pressure control unit.
Figure 13:
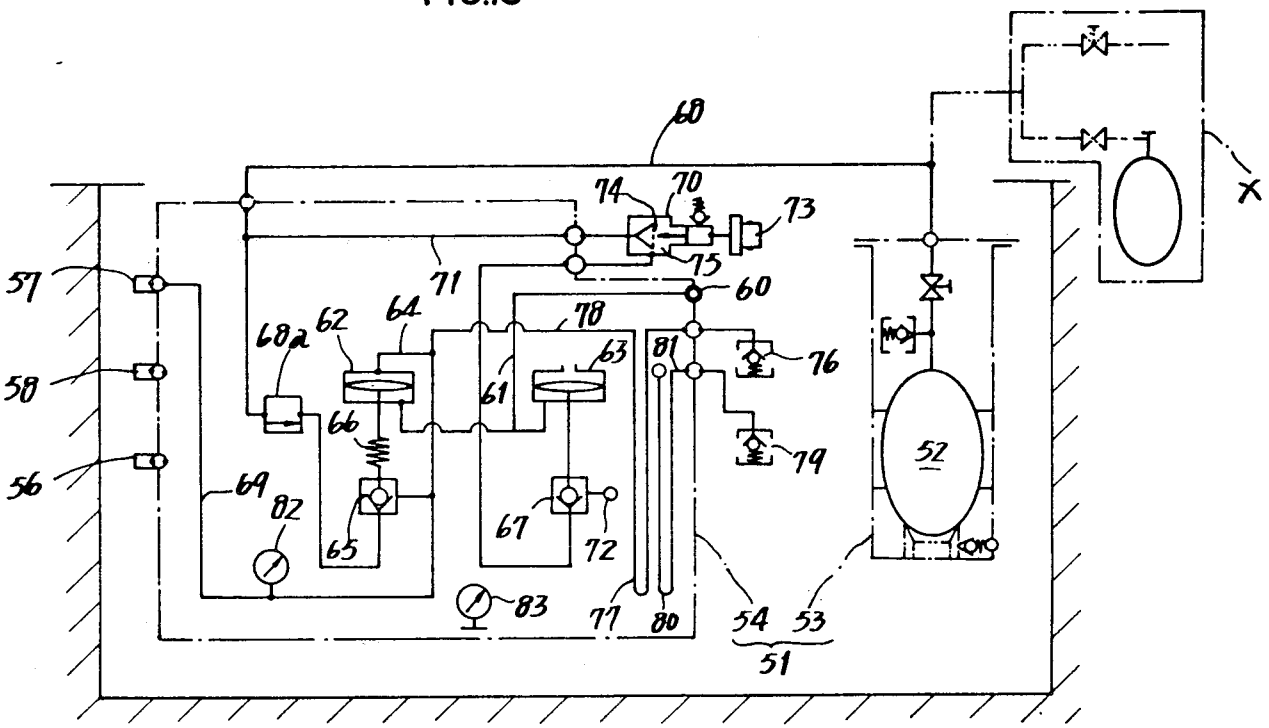
FIG. 13 is a diagram showing the circuit of the pressure control unit.
Figure 14:
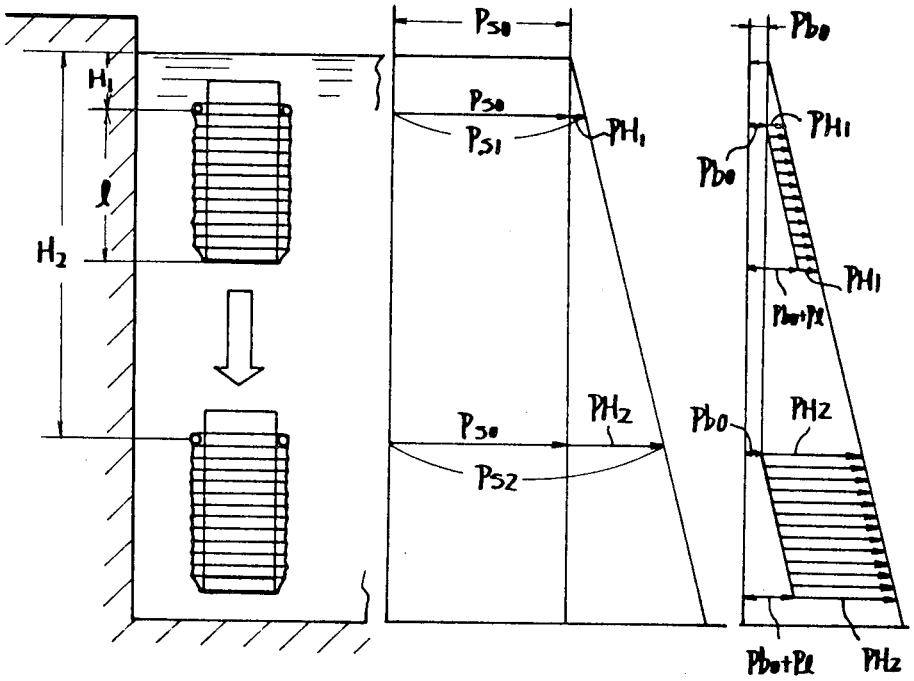
FIG. 14 is a diagram illustrating the method of pressure control.

With reference to FIGS. 12 to 14, a control system will be described below for effecting pressure compensation against the pressure of water to be exerted on the annular tube, or on the annular tube and the bag. The control system will be described as used for the first embodiment of FIG. 1 in which the interior of the annular tube is set to a specified sealing pressure (for example, of 1.5 kg/cm$^2$) and the bag is set to a specified internal negative pressure (for example, of −0.04 kg/cm$^2$). The application of the system for the other embodiments will be apparent and will not be described.

FIGS. 12 and 13 show a pressure control unit 51 comprising a casing 53 housing a pressure supply container 52, and a main body casing 54 housing a control system. The casings are joined together in a compact arrangement and attached to an upper portion of the cask by a fitting band 55. The main body casing 54 has a connecting outlet 56 and another connecting outlet 57 which are adapted for communication with the interior of the bag 11 and the interior of the annular tube 12 by suitable flexible pipes (not shown) respectively. The main body casing 54 further has an outlet 58 for connection to a vacuum pump which outlet is in communication with the bag connecting outlet 56 by way of the internal space of the main body casing 54. The main body casing 54 has a pressure detecting port 60 through which the pressure of water is detected in accordance with the depth after the port has started to submerge. The result is fed through a pressure detecting line 61 to a tube pressure control valve 62 and to a bag pressure control valve 63. The valve 62 is connected to a line 64 for applying internal pressure to the tube, while the internal pressure of the main body casing 54 is fed to the control valve 63. Accordingly the pressure control valve 62 opens its valve channel 65 in accordance with the variation of the difference between the pressure of water, $P_H$, detected and the sum of the initial set pressure $P_S$ or subsequent internal pressure of the annular tube 12 and an increment $\Delta P_H$ of the internal pressure due to the deformation of the tube 12 resulting from an increase in the water pressure (see FIG. 2). Indicated at 66 is a spring for compensating for the initial set pressure $P_S$. On the other hand, the pressure control valve 63 opens its valve channel 67 in accordance with the variation in the difference between the detected water pressure and the specified negative pressure within the bag 12 or subsequent internal pressure of the bag. A pressure supply line 68 extending from the pressure supply container 52 communicates with a line 69 through which pressure is supplied to or released from the annular tube 12. A line 71 for supplying pressure to the bag branches off from the pressure line 68, has an intermediate start valve 70 and communicates with the valve channel 67 of the pressure control valve 63. The valve channel 67 has an opening 72 to the interior of the main body casing 54. The start valve 70 has a resistivity-sensitive gas generator 73, which operates simultaneously with immersion into the body of water, generating a gas and breaking a shield 74 to open a valve channel 75. A check valve 76 for releasing pressure from the annular tube is in communication with the pressure supply-release line 69 by way of a line 78 for releasing pressure from the annular tube, the line 78 having a trap 77. A check valve 79 for releasing pressure from the bag is in communication with the interior of the main body casing 54 via a line 81 for releasing pressure from the bag, the line 81 having a trap 80. The check valves 76 and 79 are provided outside the main body casing 54. When the interior of the bag 12 is maintained at a negative pressure relative to the external pressure, the check valve 79 is positioned above the pressure detecting port 60 by a head corresponding to the negative pressure. Indicated at 82 and 83 are pressure gauges for indicating the internal pressures of the annular tube 12 and bag 11 respectively.

The control system operates in the following manner. With reference to FIG. 14, designated at $P_{S0}$ is the initially set internal pressure of the annular tube required for sealing, and at $-P_{b0}$ the negative set pressure within the bag. It is now assumed that the cask 1 is immersed in the fuel pool under the above pressure conditions and that the annular tube 12 and the pressure detecting port 60 of the control system are both positioned at a depth $H_1$ for the convenience of description. When the head at the depth $H_1$ is $P_{H1}$, the pressure $P_{H1}$ acts externally on the annular tube 12, slightly deforming the tube 12 in cross section, with the result that the interior of the tube 12 is subjected to the sum of $P_{S0}$ and a small increment $\Delta P_{H1}$ in proportion with the external pressure $P_{H1}$, namely $P_{S0}+\Delta P_{H1}$ (see FIG. 2). Thus the difference in pressure between outside and inside the tube 12, which has been $P_{S0}$ while the tube is in the atmosphere, is $P_{S0}-(P_{H1}-\Delta P_{H1})$ at the depth $H_1$, thus impairing the reliability of the seal. It is noted that the combined internal pressure of the tube, $P_{S0}+\Delta P_{H1}$, and the water pressure $P_{H1}$ detected at this time are fed to the tube pressure control valve 62 described with reference to FIG. 13, with the pressure $P_{S0}$ compensated for by the spring 66, so that the valve channel 65 is opened in accordance with the difference between $P_{H1}$ and $\Delta P_{H1}$, permitting the pressure supply container 52 to supply the pressure gas to the tube 12 via the pressure line 68, reducing valve 68*a*, valve channel 65, pressure supply-release line 69 and connecting outlet 57 until the internal pressure, $P_{S1}$, of the tube 12 reaches $P_{S0}+P_{H1}$, whereupon the valve channel 65 is closed. In this way, the internal-external pressure difference $P_{S0}$ is established for the tube 12, thus assuring a reliable sealing effect. When the cask 1 is further lowered to bring the annular tube 12 to a depth $H_2$, the control system operates similarly, supplying the pressure gas to the tube 12 until the internal pressure $P_{S2}$ equals to $P_{S0}+P_{H2}$ to give the internal-external pressure difference $P_{S0}$ to the tube 12 for reliable sealing action. Conversely if the cask 1 is raised with the tube 12 shifted from the depth $H_2$ to the depth $H_1$, an excess of pressure corresponding to $P_{H2}-P_{H1}$ is released into the water via the supply-release line 69, release line 78 and check valve 76, because the valve 76 has such a pressure compensation spring that the valve is opened when subjected to the pressure of the sealing pressure $P_{S0}$ plus a small pressure $\Delta P$, namely $P_{S0}+\Delta P$, the valve further being so adapted that the external water pressure exerted thereon acts to close the valve. Consequently the valve 76 maintains the internal-external pressure difference involved in the tube 12 at a value of up to $P_{S0}+\Delta P$ at all times.

The external pressure on the bag 11 will now be discussed with reference to the right-end section of the diagram of FIG. 14. The bag 11, while in the atmosphere, is subjected to an external pressure $P_{b0}$ corresponding to the absolute value of the negative pressure $-P_{b0}$ to which the bag is set. It is now assumed that the pressure detecting port 60, namely the upper end of the bag 11, is positioned at the depth $H_1$. Unless a compensation pressure is fed to the interior of the bag 11, the upper end will be subjected to an external pressure of $P_{b0}+P_{H1}$, and the lower end to an external pressure of $P_{b0}+P_l+P_{H1}$ where l is the length of the bag 11, and $P_l$ is the head difference. With the internal pressure, $-P_{b0}$, of the bag 11 and the pressure of water, $P_{H1}$, detected fed to the bag pressure control valve 63, the valve channel 67 is opened in accordance with the pressure difference between $P_{H1}$ and $-P_{b0}$, with the result that the pressure gas is sent out from the pressure supply container 52 to the bag 11 by way of the pressure line 68, pressure line 71, start valve channel 75, pressure control valve channel 67, opening 72, interior space of the main body casing 54 and connecting outlet 56 until the internal bag pressure reaches $P_{H1}-P_{b0}$. Thus the external pressure on the bag 11 is limited to $P_{b0}$ at its upper end and to $P_{b0}+P_l$ at its lower end. The control system operates similarly when the cask 1 is further lowered to bring the upper end of the bag 11 to the depth $H_2$, supplying the pressure gas until the internal bag pressure reaches $P_{H2}-P_{b0}$ and limiting the external pressure on the bag 11 similarly as above. Conversely if the bag 11 is raised from the depth $H_2$ to the depth $H_1$, an excess of pressure corresponding to $P_{H2}-P_{H1}$ is released into the water via the interior space of the main body casing 54, bag pressure release line 81 and check valve 79. Since the check valve 79 is positioned above the upper end of the bag 11 by a head corresponding to $-P_{b0}$, the internal pressure of the bag 11 is limited at all times to a level slightly higher than $P_H-P_{b0}$. Apparently, however, the initial negative internal pressure of the bag 11 in the atmosphere must be given forcibly from outside. Further when the submerged cask 1 is raised to the atmosphere, a positive pressure will be applied to the interior of the bag, so that it is impossible to reduce the internal bag pressure to a level lower than the atmospheric pressure by the check valve 79, whereas even at this time the bag will not inflate in the atmosphere since the bag 11 has been maintained at the specified negative pressure relative to the external water pressure and in intimate contact with the cask outer surface, with the interior of the bag 11 sealed off from outside by the check valve 79. Thus the bag can be held in contact with the cask when raised to the atmosphere, causing no trouble to the operation. In any case, the pressure gas is fed to the bag 11 in accordance with the pressure of water, permitting a substantially uniform external pressure to act on the bag 11 irrespective of the depth of water without producing any adverse effect on the strength of the bag and allowing the bag to retain the specified negative pressure relative to the external pressure throughout the entire operation. This enables the bag to retain the initial shape in the cask covering state throughout the whole operation.

The traps 77 and 80 provided for the tube pressure release line 78 and the bag pressure release line 81 respectively serve to prevent the contaminated water of the fuel pool from flowing reversely through the check valves 76 and 79 into the tube pressure control valve 62 and the bag pressure control valve 63, thus precluding the possible contamination of these parts.

Indicated at X in FIG. 13 is a pressure source on the ground. Alternatively a pressure source of the submerged type may be usable when so desired.

Although the foregoing embodiments each comprise a characteristic combination of the components, the present invention also includes various changes of the components and modified combinations of the elements disclosed within the scope and spirit of the invention.

What is claimed is:

1. In a cask bagging device including an open-ended bag for covering the outer surface of a cask to protect the same from contamination, the improvement comprising a flexible annular tube extending about the open end of the bag to hold said open end in sealed relation to the cask, means for feeding a gas pressure to the interior of said annular tube, and a system for controlling the gas pressure in accordance with external water pressure at a position close to said annular tube.

2. A cask bagging device as defined in claim 1 wherein the tube is fixedly joined to the open end edge of the bag.

3. A cask bagging device as defined in claim 1 wherein the tube has a diameter permitting the tube to fit into the space between a pair of annular fins formed on the outer surface of the cask.

4. A cask bagging device as defined in claim 1 wherein the tube is provided with a member of high rigidity for restraining deformation of at least part of the outer surface of the tube except the portion thereof to be brought into pressing contact with the outer surface of the cask.

5. A cask bagging device as defined in claim 1 wherein the bag comprises a lower bag segment in the form of a bottomed tubular sheet for covering the lower portion of the cask and an upper bag segment in the form of a tubular sheet for covering the upper portion of the cask and is provided with a second annular tube for holding in pressing contact with the cask outer surface a lap of the upper end of the lower bag segment and the lower end of the upper bag segment, said first-mentioned annular tube holding the upper end of the upper bag segment in pressing contact with the upper end of the cask.

6. A cask bagging device as defined in claim 1 wherein the bag comprises a bottom portion and a tubular portion, the tubular portion being in the form of a bellows-shaped sheet and being internally provided with an annular rib at each of the folds of major diameter of the bellows.

7. A cask bagging device as defined in claim 1 wherein the bag is made from a sheet comprising two synthetic resin films, a synthetic resin fiber fabric sandwiched between the two films and a layer of soft rubber formed on the outer surface of one of the films.

8. A cask bagging device as defined in claim 1 further comprising means for feeding a gas pressure to the interior of the bag and a system for controlling the gas pressure of the bag in accordance with external water pressure at a position close to the bag.

9. A cask bagging device as defined in claim 1 wherein the controlling system comprises a pressure supply line having an intermediate pressure control valve and connecting the annular tube to the gas pressure feeding means, a pressure detecting line for detecting the external water pressure and transmitting the detected pressure to the pressure control valve, and a pressure release line having a check valve at one end open to an outer space and keeping the annular tube in communication with the outer space.

10. A cask bagging device as defined in claim 8 wherein the controlling systems comprise pressure supply lines each having an intermediate pressure control valve and connecting the gas pressure feeding means to the annular tube and to the bag respectively, pressure detecting lines for transmitting the external water pressures to the pressure control valves respectively, and pressure release lines each having a check valve at one end open to an outer space and keeping the annular tube and the bag in communication with the outer space.

11. A cask bagging device as defined in claim 10 wherein the pressure supply line connecting the gas pressure feeding means to the bag has an intermediate start valve which opens its channel when the cask is immersed into water.

12. A cask bagging device as defined in claim 1 wherein the control system is housed in a casing attached to the cask.

13. A cask bagging device as defined in claim 8 wherein said system for controlling the gas pressure of the bag is housed in a casing attached to the cask.

14. A cask bagging device as defined in claim 12 or 13 wherein the casing houses the gas pressure feeding means.

* * * * *